United States Patent [19]

Chang

[11] Patent Number: 4,486,959

[45] Date of Patent: Dec. 11, 1984

[54] PROCESS FOR THE THERMAL DEWATERING OF YOUNG COALS

[75] Inventor: Tsuan Y. Chang, Baldwin, N.Y.

[73] Assignee: The Halcon SD Group, Inc., New York, N.Y.

[21] Appl. No.: 565,421

[22] Filed: Dec. 27, 1983

[51] Int. Cl.[3] ..... F26B 3/00

[52] U.S. Cl. ..... 34/9; 34/14; 110/238; 110/224; 44/1 G

[58] Field of Search ..... 110/238, 218, 221, 224, 110/230; 34/9, 14; 44/1 G, 1 R, 6

[56] References Cited

U.S. PATENT DOCUMENTS

| | | | |
|---|---|---|---|
| 2,638,684 | 5/1953 | Jukkola | 34/9 |
| 3,520,067 | 7/1970 | Winegartner | 34/9 |
| 3,564,722 | 2/1971 | Wheeler | 34/9 |
| 4,395,334 | 7/1983 | Nakabayashi et al. | 44/1 G |
| 4,411,879 | 10/1983 | Ehrlich et al. | 34/9 |
| 4,422,246 | 12/1983 | Handesty et al. | 34/9 |

*Primary Examiner*—Henry C. Yuen

*Attorney, Agent, or Firm*—William C. Long; R. T. Stewart; D. R. Zirker

[57] ABSTRACT

An economic process for thermally dewatering a solid carbonaceous material containing substantial amounts of chemically attached water is disclosed. The process is capable of economically removing up to 95% of the chemically attached water in the disclosed process.

9 Claims, 1 Drawing Figure

PROCESS FOR THE THERMAL DEWATERING OF YOUNG COALS

BACKGROUND OF THE INVENTION

1. Field of the Invention

This invention relates to an improved method for the thermal dewatering of solid carbonaceous substances and, more particularly, to a method for the thermal upgrading by dewatering of young coals in an efficient and economic manner. The term "young" coal as used herein describes a class of coals falling outside the range of hard coals and includes subbituminous coal, lignite and unconsolidated brown coals. Other carbonaceous substances suitable for use include peat, wood, vegetable material, sewage, sludge and the like.

It is highly desirable that such carbonaceous materials be thermally upgraded in an efficient and economic manner so as to improve their heat generating capabilities, thereby becoming useful in applications involving thermal decomposition and gasification processes. Furthermore, such an upgrading for a pipeline slurry also results in a considerable reduction in transportation costs.

In the United States vast deposits of various grades of young coal reside, particularly in the western half of the nation. These deposits represent a potential solution to the modern energy crisis and resulting fuel shortages. Unfortunately, young coal as mined usually contains a substantial amount of moisture, and it is essential that at least the majority of this water be removed from the coal in order to render it suitable as a fuel.

It is known that at high temperatures coal not only will lose this chemically attached water, but also will undergo a change in structure so that no substantial reabsorption of the water will occur even if the coal is kept in a water phase under high pressure. Such resistance is due to a chemical change in the coal itself, a phenomena known as coalification.

2. Description of the Prior Art

A number of attempts have been made to develop an economic and efficient process of dewatering young coal and other similar carbonaceous substances by subjecting the material to a variety of heat treatments at elevated pressures. A common theme underlying these efforts is that in order to convert young coal to a lesser water bearing substance there should be as little water as possible in the immediate environment, particularly during depressurization and cooling, so that a minimum of water is required to be separated from the coal after the heat treatment.

Several processes have heretofore been used or proposed for treating young coal so as to render it more effective as a solid fuel. These processes usually involve a partial drying of the coal in its as-mined condition to reduce its moisture content, followed by a subsequent processing to render the coal more impervious to moisture. Another class of processes has involved dehydrating the coal initially to a low moisture content by conventional drying methods; however, the amount of heat required to energize the drying gas stream to a temperature required for the dehydration of young coal can be as high as 25% in terms of the heat value of the coal based on the amount of young coal that is originally treated.

U.S. Pat. No. 3,552,031, Evans et al, discloses the separation of contained water from a stream of solid, non-slurried brown coal and other organic materials by treatment of the organic materials in the presence of a fluid medium at an elevated temperature of about 250° C. and at pressures exceeding the saturation pressure.

U.S. Pat. No. 4,052,168, Koppelman, discloses a process for upgrading lignitic type coals by treating the moist, mined solid coal to an autoclaving process at very high temperatures (500°-600° C.) and elevated pressures for a time sufficient to convert the moisture and a substantial portion of the volatile organic constituents therein to a gaseous phase, consequently producing a controlled thermal restructuring of the chemical structure.

U.S. Pat. No. 3,922,784, Verschuur et al, discloses a process for the upgrading of carbonaceous substances, particularly brown coal, which involves a heat treatment of a slurried coal stream at a temperature of at least 150° C. and a pressure above the vapor pressure of water at the corresponding temperature. The slurry is pressurized at a temperature below 100° C. prior to the heat treatment.

Canadian Pat. No. 1,020,477, Wasp, discloses a process for increasing the heat and coal concentrations of a solid, carbonaceous slurry by thermal dewatering the slurry at elevated temperatures and pressures; the treated slurry is then more suitable for pipeline transportation to a designated point.

However, the processes of the prior art which are directed at dewatering a coal slurry either fail to remove a sufficient amount of water from the coal particles or require too large an amount of energy to be economical.

The process of the present invention overcomes the problems and disadvantages of the prior art methods through an improved thermal dewatering process leading to the production of an upgraded solid heating fuel in a novel, economic and energy efficient manner.

An object of this invention is to provide an improved method for the effective and economic dewatering of young coal and other moisture bearing carbonaceous slurried substances in order to use the resultant product as an improved feed coal in a variety of energy requiring processes.

It is another object of this invention to economically separate as much of the surface and chemically attached water from the coal as possible, without permitting the water to be reabsorbed into the coal.

It is still another object of the invention to utilize and recover the heat and pressure generated by the various unit operations of the process in an efficient manner.

Various other objects, features and attendant advantages of the present invention will be more fully appreciated from the following detailed description of the invention when considered in connection with the accompanying drawing, wherein FIG. 1 represents a flow chart illustrating the preferred embodiment of the process.

SUMMARY OF THE INVENTION

According to the invention, an economic and energy efficient process for thermally dewatering a solid carbonaceous material containing substantial amounts of chemically attached water, and/or volatile constituents, e.g., from 30-90 wt. % water is accomplished by the steps of preparing an aqueous slurry of the carbonaceous material, i.e., young coal; pressurizing and heating the slurry to a temperature in the range of about 150° C. to 350° C. at a corresponding pressure sufficient to prevent vaporization of water in order to release the chemically attached water of the coal into the liquid phase without necessitating vaporization. The slurry then passes into a gas separation unit wherein the $CO_2$ present together with some water vapor leaves the slurry, preferably while recovering some of the heat present in the $CO_2$-$H_2O$ high pressure vapor as power, e.g., in an expansion turbine or the like. The heated, pressurized slurry exiting the gas separation unit is passed through a heat exchanger where it is cooled by an effective heat transfer fluid circulating in the system. The cooled, pressurized slurry is then passed into a suitable pressure filter, preferably an automatic chamber filter, which removes sufficient water to form a dry coal cake having a minimal, e.g., about 10–15% water content. The removed water either is recycled to the mixing unit or purged from the system, while the filter cake is further dried by contacting with a hot gas stream, preferably a hot flue gas stream from the Dowtherm boiler, which separates the coal filter cake from the remaining adhering free water particles present. The dried, dewatered coal, having had up to 95% of its moisture removed, is collected as product in a cyclone or other effective separation unit, while the hot gases are purged from the system.

DETAILED DESCRIPTION OF THE INVENTION

Figure 1:
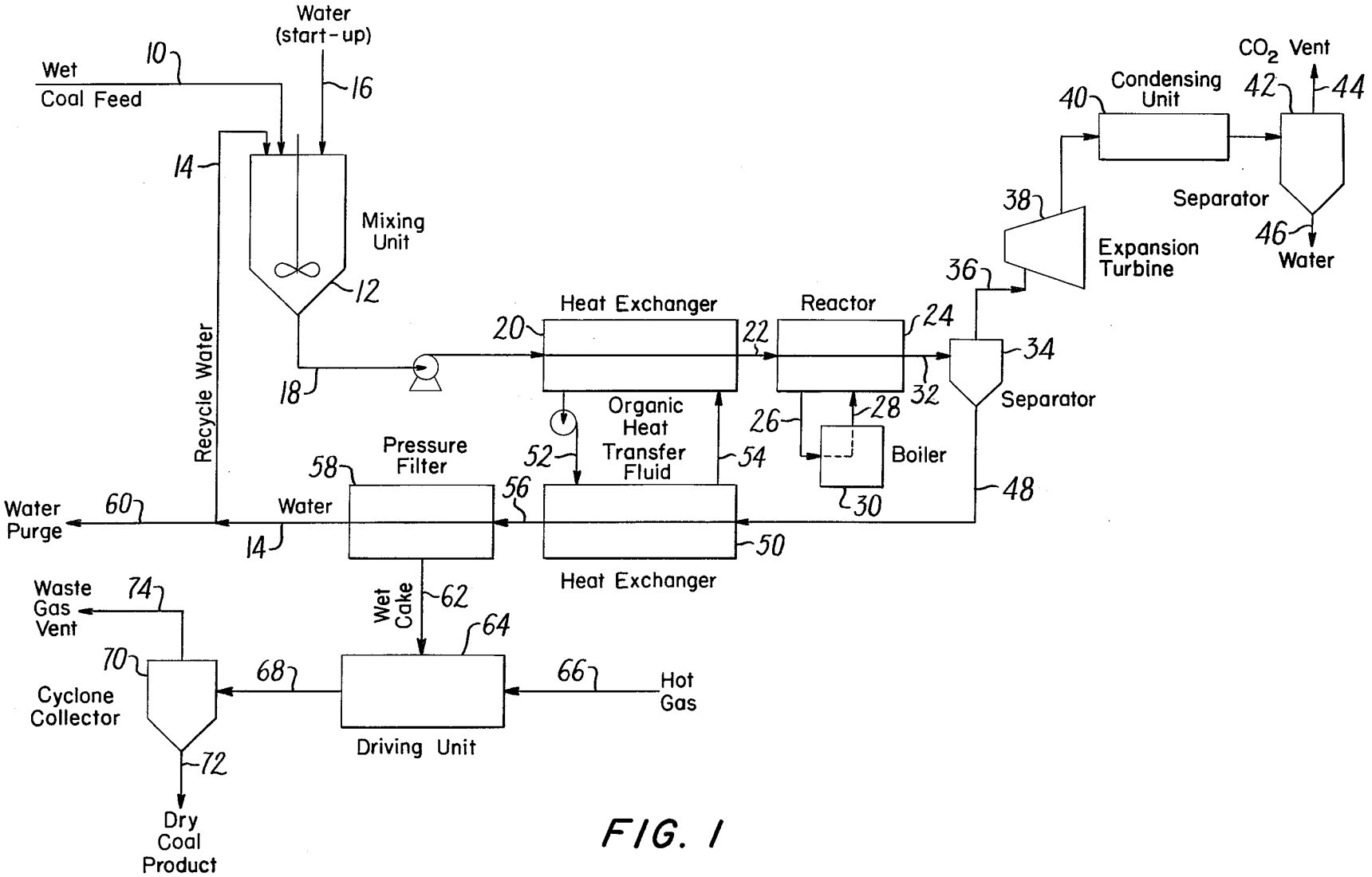

The process of the invention, in the broadest embodiment, is applicable for upgrading a wide variety of carbonaceous substances, particularly young coals and including peat, brown coal, lignites, and subbituminous coals which are found in deposits similar to higher grade coals. Such substances usually contain from as little as about 30% up to about 90% moisture. It is usually preferred to conduct a screening or a crushing of the mined brown coal in order to remove any large agglomerates so as to facilitate the handling characteristics of the coal. The exact size and configuration of the finished coal particles, however, is not critical in achieving the benefits of the novel process.

A critical advantage of using a slurry mode of operation is that a pumped slurry can be much more easily heated, cooled, pressurized and depressurized in a continuous process than can a solid charge. For example, it is most preferred to cool the slurry while recovering the invested heat from the heat treated slurry by heat exchange with other process streams present. Also heat transfer is far more efficiently conducted through a pumpable slurry than through a solid charge.

Thus, according to the process in the preferred embodiment, a carbonaceous, i.e., young coal, slurry is first prepared which comprises a solid material in finely divided form. The slurry may be prepared by a variety of well known methods, such as by grinding lumps of the solid material followed by dispersing the ground material in water, or by grinding a solid material together with water. The slurry can also be prepared at another location and transported to the dewatering unit by pipeline. In the case of young coal, the material may have been mined by means of water, in which case a slurry will be available after the wet grinding operation. In any event, preparation of a slurry is a well known technique in the art, and as such there are a large number of technically proven processes which are readily adaptable for this method.

In the preferred process embodiment of the invention as outlined in FIG. 1, wet brown coal feed 10, or another suitable solid carbonaceous substance, prepared by passing through a crusher or other comminution unit and being crushed to a predetermined particle size, preferably about minus ¼ inch or smaller, is pulverized and preheated (not shown) and enters mixing unit 12 wherein it is mixed with a recycled water stream 14 and, during startup, water from line 16. The resulting mixture is pumped through conduit 18, now forming a slurry in a pressurized system, and enters heat exchange unit 20. The slurry is heated by contacting with a heated organic heat transfer fluid, e.g., "Mobiltherm" or the like, and passes through line 22 into reactor unit 24 where is is further heated to about 150°–350° C., preferably about 250°–300° C., under a corresponding pressure sufficient to prevent vaporization of the water. The heating of the slurry in the reactor unit is preferably accomplished by the condensation of the vapor of a second organic heat transfer fluid, e.g., "Dowtherm", or the like, which enters the reactor unit 24 by line 28, the organic vapor being generated in boiler 30. The condensed organic vapor is recirculated to the boiler through line 26. Depending upon the chemical structure of the coal and the severity of the treatment, in excess of 90 wt. % of the chemically attached water present in the coal can be thermally removed without evaporation, thus saving substantial amount of energy required for the removal of the water.

The thermal restructuring of the coal which occurs during this operation is not completely understood, but is believed to involve at least two simultaneous chemical reactions occurring within the cellular structure of the coal. The net effect of these restructuring reactions results in the formation of coal particles which are substantially more resistant to moisture absorption and decrepidation, as well as producing changes in the chemical composition of the coal.

The heated and substantially dewatered coal slurry leaves the dewatering reactor unit 24 and passes through line 32 into gas separation unit 34, where the $CO_2$, together with some water vapor and other gases present are removed by passing through line 36. The resulting gas mixture can enter, if sufficient energy is present therein, into a power producing unit 38, preferably an expansion turbine or the like, and later pass into condenser unit 40. Sufficient horsepower can be recovered from the turbine and used to generate power, which can, for example, be used to drive the systems pumps. The effluent from the condenser unit passes into separator unit 42, where the $CO_2$ and some uncondensed water exit the system through lines 44 and the condensed water through line 46. Meanwhile, the heated coal slurry stream leaves gas separator unit 34 and passes through line 48 to heat exchange unit 50 where it is cooled, preferably by heating the cooled "Mobiltherm" or other suitable organic heat transfer fluid stream, which circulates from heat exchange unit 20 through line 52 and returns thereto in heated condition through line 54. The cooled and pressurized coal slurry exits heat exchange unit 50 through line 56 and enters pressure filter unit 58, which is particularly suitable for use since substantially all the water now present in the slurry is free, i.e., not chemically attached to the coal, and hence can be removed by filtration. The high pressure of the coal slurry stream is also utilized to pressure the water through the pressure filter unit, which is preferably an automatic chamber filter such as sold by Larox, Inc. of Columbia, Md., or the like. The liquid filtrate, e.g., water from pressure filter 58 passes through line 14 where it is partly purged from the system (line 60) and partly recycled to mixing unit 12 for diluting the coal feed slurry. The wet coal filter cake is passed through line 62 to drying unit 64 for final drying.

It is economically essential that the coal particles in the slurry be recovered with as little water as possible. Superior results can be obtained by having the coal filter cake enter a drying unit and be contacted with a hot flue gas or other heated gas stream 66, which is most preferably supplied as a waste gas stream from a coal gasification plant or another suitable industrial gas source. The use of such a stream of gas will achieve the desired quick physical separation of the now dewatered coal particles from the remaining "free" water. This is helpful in keeping reabsorption of water by the coal particles to a minimum.

After contacting and mixing with hot gas stream 66, the now dewatered and dried coal product is passed through line 68 to cyclone collector unit 70, where it is removed as dry coal product 72, and can be used as fuel or for some other desired purpose. In another embodiment of the invention the underflow slurry from heat exchanger 50 may be maintained under pressure and transported to a slurry surge tank (not shown), whereupon it forms a high coal content slurry, i.e., 70 wt. %, and can be subsequently used in a coal gasifier, pipeline or boiler.

The flue gas stream 74 which exits the cyclone collector is preferably vented from the system. In the broadest embodiment of the invention the separation of at least part of the free water from the treated slurry may be carried out either before, during, or after cooling and/or depressurizing the treated slurry. However, the thermal efficiency and resulting economy of the process is maximum when the process as so described above in the preferred embodiment is followed. The thermal efficiency of the process is surprisingly high and is due to the use of non-evaporating removal of water, the usage of effective heat exchanging means and fluids throughout the process cycle, the usage of an expansion turbine to recover power from the off gases, and the utilization of a pressure filter unit, which utilizes the available pressure of the coal slurry to filter a substantial amount of water from the now dewatered coal, and makes possible the removal of up to 95% of the water initially present in the coal feed.

The residence time of the young coals in the reactor unit 24 can range from about 1 to 30 minutes, depending upon the nature of the coal and the specific temperature, pressure and time relationships which are inherent within the parameters as hereabove set forth, so as to effect a substantial removal of the water content, together with a controlled thermal restructuring of the coal product.

Aqueous slurries of solid particles, in order to be pumpable, must at least contain a certain percentage of free water, i.e. water that is not chemically bound or otherwise enclosed in the solid material. The amount of free water required depends on a number of factors, particularly the particle size and the size distribution of the slurry.

The following example is provided to illustrate the invention in accordance with the principles of this invention but are not construed as limiting the invention in any way except as indicated by the appended claims.

EXAMPLE 1

100,000 lb/hr of pulverized coal on a dry basis containing 200.000 lb/hr of chemically attached water is fed into a conventional mixing unit. At least 99 wt. % of the coal particles are smaller than 1.4 millimeters in diameter, with over 40% being less than 150 micrometers. The pulverized coal is mixed with 150,000 lb/hr of recycled water from the downstream dewatering system when it passes into the mixing unit in order to facilitate downstream pumping and heat exchange. The resulting slurry is pressurized to 850 psi and enters a countercurrent heat exchanger at 50° C. where it is heated to 230° C. by contacting through tube walls with a hot (240° C.) heat transfer "Mobiltherm 605" stream, which had been heated in a downstream heat exchanger. The coal slurry is further heated to 250° C. by condensing "Dowtherm A" organic vapor in the reactor and held there for about five minutes to enable the dewatering to take place, and exits the reactor at 250° C. and 800 psi. The Dowtherm vapor is generated in a conventional boiler and circulated to the dewatering reactor, with the condensed Dowtherm being returned for subsequent reuse. About 3% of the dry coal is decomposed into $CO_2$ and other gases during dewatering. These gases exit the reactor with about 3,000 lb/hr of water vapor and, together with the coal slurry, enter a conventional gas separator. The $CO_2$-$H_2O$ gas mixture passes through a multi stage expansion turbine which generates 272 horsepower which can be used to satisfy some power requirements of the process. In this example, the $CO_2$ and $H_2O$ upon leaving the turbine are vented to the atmosphere, although when the gas mixture is rich in $H_2O$ vapor it can be passed through a condenser to recover more power.

The hot slurry leaving the bottom of the gas separator at 250° C. now consists of 97,000 lb/hr of dry coal and about 347,000 lb/hr of water, and enters a second heat exchanger where it is cooled from 250° C. to 70° C. by heating countercurrently a cooled "Mobiltherm 605" stream which has passed from the earlier heat exchanger and has been cooled from 240° C. to 60° C. The Mobiltherm circulation between the heat exchangers is maintained by a low head centrifugal pump of 1500 GPM capacity. The cooled coal slurry, now at 70° C. and 750 psi after exiting the heat exchanger, is comprised of about 22 wt. % solid, with the remaining water content being substantially free water. The pressurized stream enters a LAROX CF automatic chamber pressure filter and produces a coal cake comprised of 97,000 lbs/hr of dry coal and 14,500 lbs of water, with the remaining 332,500 lbs/hr of water leaving as filtrate water and 150,000 lbs/hr of this being recycled to the mixing unit with the remainder purged from the system.

The coal cake exiting the pressure filter is then contacted in a dryer by a waste flue gas stream at 450° C. from the Dowtherm boiler. The resulting dried product leaves the dryer and 97,000 lbs/hr of dry coal with only 9,700 lbs/hr of water is taken away as final product. Thus, of the 200,000 lbs/hr of water in the feed coal, over 95% has been removed. About 3,000 lbs/hr of dry coal is used as the fuel for the Dowtherm boiler.

I claim:

1. An economic and energy efficient process for the thermal dewatering of coal comprising:

preparing an aqueous slurry of the coal;

pressurizing and heating the slurry to a temperature range of about 150°–350° C. and a corresponding pressure sufficient to prevent vaporization of water in order to release the chemically attached water of the coal into the liquid phase;

passing the slurry through a gas separation unit to separate the $CO_2$ and some water vapor therefrom;

cooling the heated slurry by transfering heat to a cooled heat transfer fluid in a suitable heat exchange unit;

pressure filtering the pressurized coal slurry to form a dry coal filter cake having a minimal water content;

contacting the filter cake with a hot gas stream to further dry the coal particles;

collecting the dewatered dried particles in an effective separation unit.

2. A process as claimed in claim 1 wherein the heat transfer fluid is selected from a suitable organic heat transfer fluid such as "Mobiltherm" and "Dowtherm".

3. A process as claimed in claim 1 wherein the pressure filter unit is an automatic chamber pressure filter.

4. A process as claimed in claim 1 wherein the hot gas stream is hot waste gas from a suitable industrial source.

5. A process as claimed in claim 1 wherein the aqueous slurry is heated to a temperature of about 250°-300° C.

6. A process as claimed in claim 1 wherein the residence time of the coal particles in the reactor unit ranges from about 1 to 30 minutes.

7. A process as claimed in claim 1 wherein the coal feedstock is brown coal.

8. A process as claimed in claim 1 wherein the formed coal filter cake is mixed with a desired amount of the unfiltered slurry to form a coal slurry having about 70 wt. % coal content.

9. A process as claimed in claim 8 wherein the 70 wt. % coal slurry is supplied to a coal gasifier, boiler or coal pipeline.

* * * * *